US005117796A

United States Patent [19]

Tursky

[11] Patent Number: 5,117,796

[45] Date of Patent: Jun. 2, 1992

[54] FUEL PUMPING ARRANGEMENT FOR A MARINE PROPULSION SYSTEM

[75] Inventor: Michael J. Tursky, Fond du Lac, Wis.

[73] Assignee: Brunswick Corporation, Skokie, Ill.

[21] Appl. No.: 663,112

[22] Filed: Feb. 28, 1991

[51] Int. Cl.[5] ..... F02M 37/04

[52] U.S. Cl. ..... 123/509; 123/198 C; 123/495; 123/41.44

[58] Field of Search ..... 123/198 C, 495, 41.44, 123/41.47, 509, 198 R; 417/199.1, 426

[56] References Cited

U.S. PATENT DOCUMENTS

| | | | |
|---|---|---|---|
| 1,903,481 | 4/1933 | Schweisthal | 123/509 |
| 1,963,658 | 6/1934 | Ford | 123/509 |
| 2,104,448 | 1/1938 | Babitch et al. | 123/509 |
| 2,494,742 | 1/1950 | Buske | 123/41.44 |
| 3,033,118 | 5/1962 | Hulten | 417/199.1 |
| 3,926,157 | 12/1975 | Lippitsch | 123/41.47 |
| 4,198,935 | 4/1980 | Seibt et al. | 123/41.44 |
| 4,203,710 | 5/1980 | Farr | 123/198 C |
| 4,784,088 | 11/1988 | Tamba et al. | 123/41.44 |
| 4,917,069 | 4/1990 | Kuhlen | 123/509 |
| 4,925,367 | 5/1990 | Paliwoda et al. | 123/509 |

*Primary Examiner*—E. Rollins Cross
*Assistant Examiner*—Tom Moulis
*Attorney, Agent, or Firm*—Andrus, Sceales, Starke & Sawall

[57] ABSTRACT

A fuel pump arrangement for a marine propulsion system, such as a stern drive or inboard system, includes a fuel pump mounted adjacent a water pump. The water pump includes an input shaft which is rotatably driven in response to operation of the engine, and a cam member is mounted to the water pump input shaft. The fuel pump includes an actuator member which is maintained against the cam member, so that rotation of the water pump input shaft results in reciprocating movement of the actuator member, thus operating the fuel pump.

16 Claims, 2 Drawing Sheets

FIG. 1
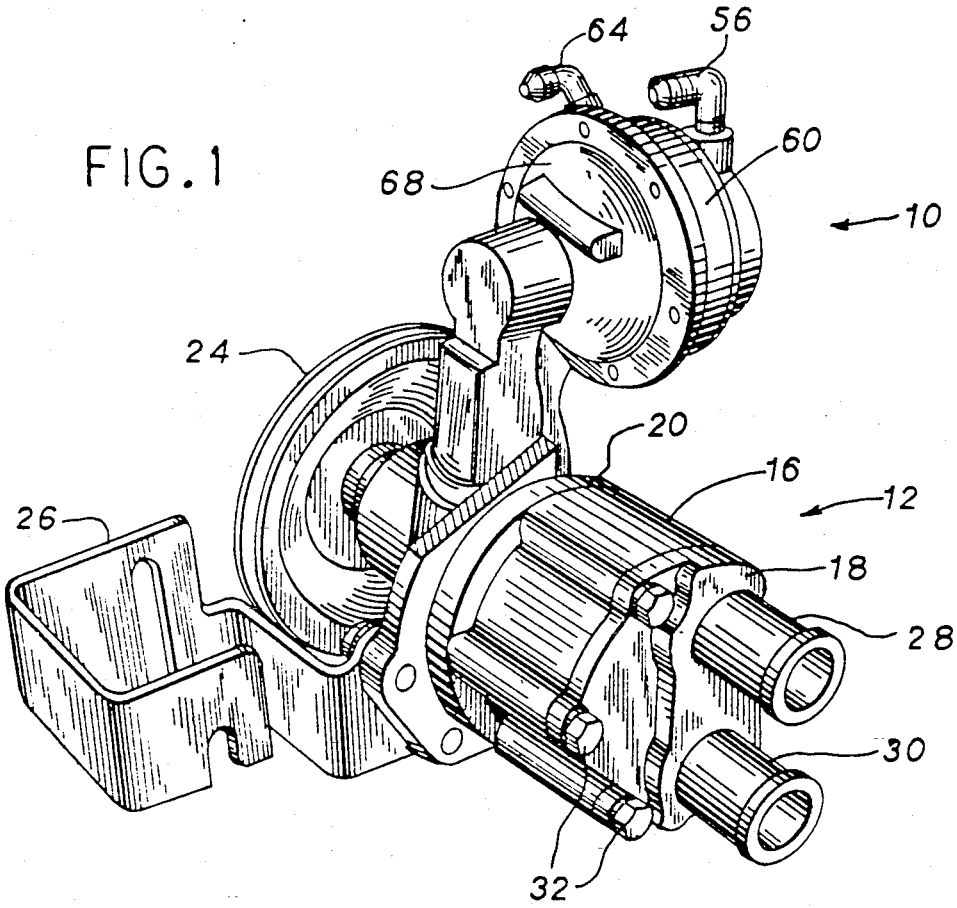
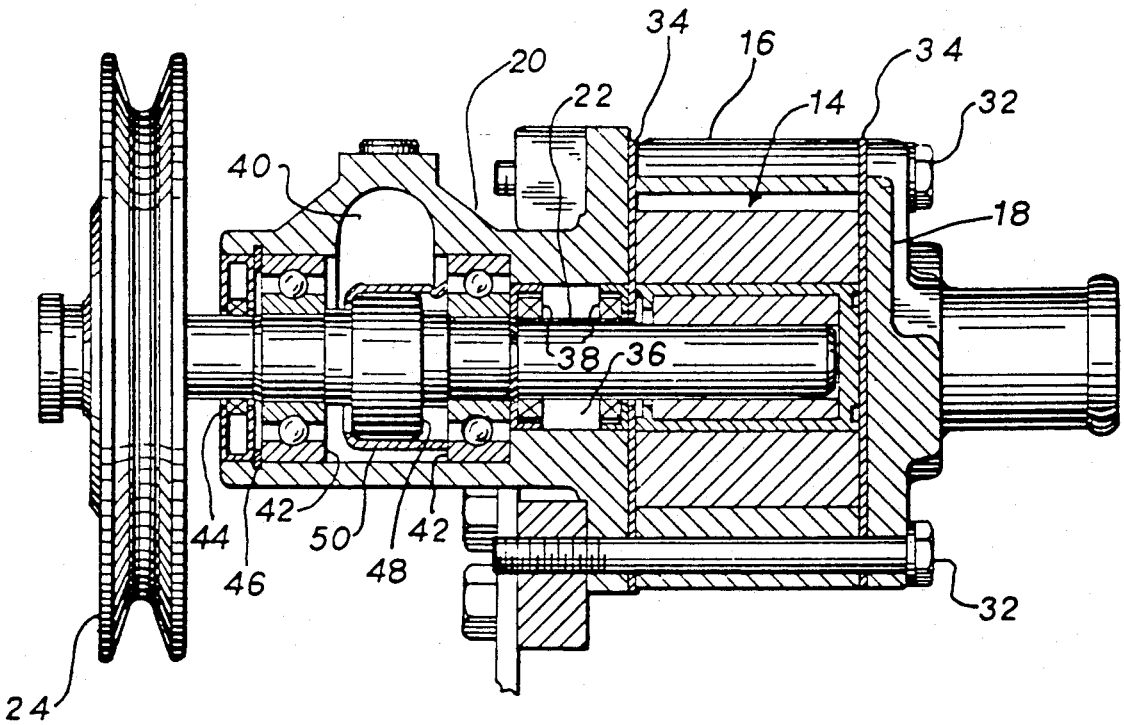
FIG. 2

FUEL PUMPING ARRANGEMENT FOR A MARINE PROPULSION SYSTEM

BACKGROUND OF THE INVENTION

This invention relates to a marine propulsion system, and more particularly to a fuel pump arrangement for a marine propulsion system.

In a marine propulsion system in which an internal combustion engine is mounted in the interior of a boat, such as a stern drive or inboard system, it is common practice to employ a mechanical diaphragm-type fuel pump to supply fuel to the engine carburetor or fuel injection system. This type of fuel pump typically includes a reciprocating actuator arm interconnected with a diaphragm pumping member. In the past, the fuel pump has been mounted directly to a mounting surface provided on the engine block, with an opening being formed in the engine block at the fuel pump mounting surface. The fuel pump was mounted to the mounting surface such that the actuator arm extended through the opening. A fuel pump push rod was mounted so as to extend between the actuator arm and a cam member mounted to the engine cam shaft. Rotation of the engine cam shaft resulted in reciprocating movement of the push rod, and thereby reciprocating movement of the fuel pump actuator arm, to operate the fuel pump.

With some engine models, the fuel pump mounting surface has been eliminated. Accordingly, it has become necessary to either use a different type of fuel pump, e.g. an electrical fuel pump, or to provide an alternate arrangement for driving a mechanical fuel pump. In a marine application, a mechanical fuel pump provides certain advantages over an electric fuel pump. For example, a mechanical-type pump does not require a return line between the pump and the fuel tank, as required by an electric pump, which can lead to fuel vapor problems as well as problems in pressure fluctuation. In addition, an electric pump requires electrical leads, and it is advantageous to reduce electrical leads in a marine application to the greatest extent possible.

Accordingly, it is an object of the present invention to provide an arrangement for operating a mechanical-type fuel pump, in which the fuel pump is not mounted to the engine block. It is another object of the invention to provide a simple and efficient fuel pump operating system, involving minor modifications to existing engine components.

In accordance with the invention, a mechanical-type fuel pump is located adjacent a water pump which is mounted to the engine for supplying water to the engine cooling system. The water pump includes a housing, an impeller, and an input shaft rotatably mounted to the housing and driven in response to operation of the engine. The water pump input shaft extends exteriorly from the housing, and a driven pulley is mounted to the end of the input shaft. The driven pulley is driven by a belt which is trained around the drive pulley mounted to the engine crankshift, so that the water pump input shaft is driven by the drive belt through the engine crankshaft. The fuel pump is driven in response to rotation of the water pump input shaft. The fuel pump includes an actuator arm which is maintained in engagement with a cam surface provided on the water pump input shaft, so that rotation of the input shaft results in reciprocating movement of the fuel pump actuator arm.

The cam surface is provided by a cam member mounted to the water pump input shaft.

With the arrangement of the invention, only minor modifications to the water pump housing are necessary to accommodate mounting of the fuel pump thereto. In addition, the water pump input shaft is modified only slightly by mounting of the cam member to the shaft. In most other respects, the water pump is substantially identical to a water pump previously employed in this type of marine propulsion system. Accordingly, the invention requires modifications to the water pump which are few in number and relatively minor in nature.

The invention further contemplates a method of operating a fuel pump, substantially in accordance with the foregoing summary.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a water pump and fuel pump assembly constructed according to the invention;

FIG. 2 is a longitudinal sectional view through the water pump assembly of FIG. 1;

DETAILED DESCRIPTION OF THE INVENTION

Figure 3:
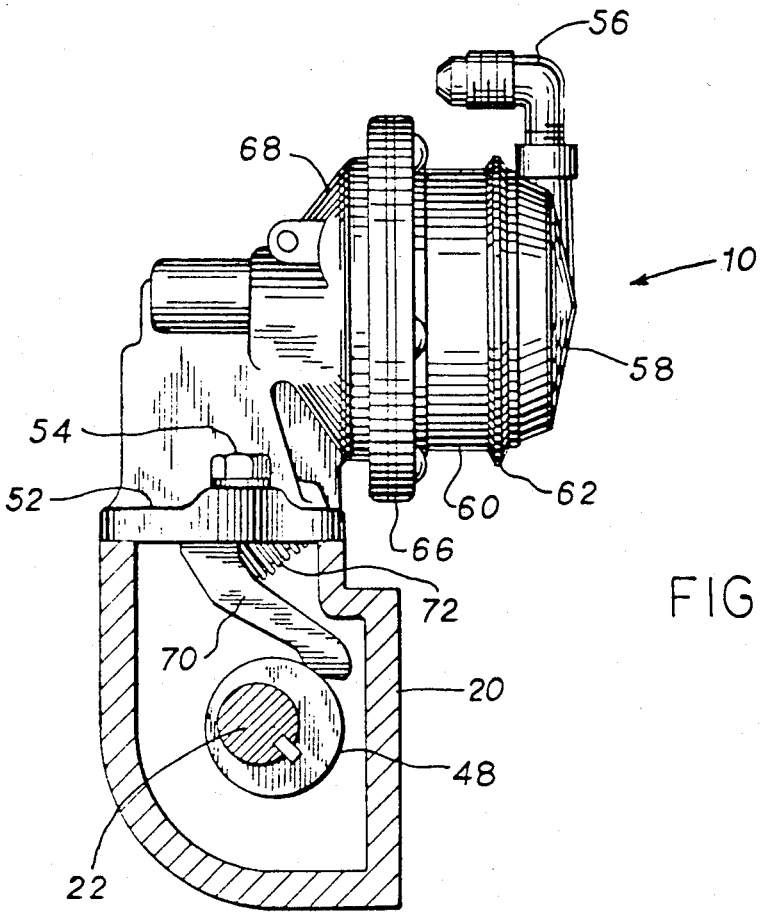
FIG. 3 is a transverse sectional view through the water pump assembly of FIG. 1.

FIG. 1 illustrates a fuel pump assembly 10 mounted to a water pump assembly 12, according to the invention. Water pump assembly 12 is generally constructed as is known in the art, as is fuel pump 10. The invention lies in the interrelationship between water pump assembly 12 and fuel pump assembly 10.

Referring to FIGS. 1 and 2, water pump assembly 12 includes an impeller 14 disposed within the internal cavity of a housing defined by a cylindrical water pump body 16, a cover member 18, and a bearing housing 20. Impeller 14 is keyed to a rotatable input shaft 22, which extends exteriorly of bearing housing 20. A driven pulley 24 is mounted to the outer end of input shaft 22. A bracket 26 is secured to bearing housing 20 for the use in mounting water pump assembly 12 to an internal combustion engine, such as is employed in an inboard or stern driven marine propulsion system. In accordance with known operation of a water pump such as 12 is such an installation, a drive belt is trained about driven pulley 24, and also about a drive pulley (not shown) which is mounted to and driven by the engine crankshaft. Accordingly, during operation of the engine, rotation of the crankshaft is transferred through the drive belt to driven pulley 24, for providing rotation of impeller 14 through input shaft 22.

Cover member 18 includes a pair of inlet/outlet nipples 28, 30. Depending on the direction of rotation of impeller 14, one of nipples 28, 30 provides intake water to the interior of the housing within which impeller 14 is located, and the other of nipples 28, 30 provides such water to the engine cooling system. The intake water is supplied from a below-water intake to the inlet nipple, to provide cooling water from the body of water in which the boat is operating, as is known.

In accordance with known construction of the housing portion of water pump assembly 12, a series of bolts 32 extend through openings formed in cover member 18 and passages formed in body 16, with the threaded portion of bolts 32 being received within threaded openings formed in the rightward end of bearing housing 20. Gaskets, such as shown at 34, are disposed between cover member 18, bearing housing 20 and the ends of body 16, for providing a water-tight seal to the interior of the housing.

A cavity 36 is formed in bearing housing 20, and a pair of oil seals 38 are provided about shaft 22 within cavity 36.

An actuator chamber 40 is formed in bearing housing 20 leftwardly of cavity 36. Oil seals 38 prevent oil from chamber 38 from mixing with water from the water pump housing.

A pair of bearing assemblies 42 are mounted within recesses formed one on either side of actuator chamber 38, and input shaft 22 is formed with bearing surfaces which engage the inner passage of bearing assemblies 42, to rotatably support input shaft 22 within bearing housing 20.

An oil seal 44 is mounted within the end of bearing housing 20 to maintain oil within actuator chamber 38 to lubricate bearing assemblies 42. A snap ring 46 is disposed between the leftwardmost bearing assembly 42 and oil seal 44, for maintaining the bearing assembly 42 in position.

Within actuator chamber 38, a cam member 48 is mounted to input shaft 22. Referring to FIG. 3, cam member 48 is keyed to input shaft 22 so as to be rotatable therewith. Cam member 48 is circular, and the center of cam member 48 is offset from the center of input shaft 22, in accordance with known construction of a cam assembly. Referring again to FIG. 2, a slip ring 50 is mounted over the outer surface of cam member 48.

FIG. 3 illustrates the interrelationship of fuel pump assembly 10 with bearing housing 20 of water pump assembly 12. As shown in FIG. 3, bearing housing 20 is provided with an upwardly facing opening, and water pump assembly 10 includes a mounting plate 52 which is located over and encloses the upwardly facing opening in bearing housing 20. Bolts, such as shown at 54, engage threaded openings formed in bearing housing 20 to secure fuel pump assembly 10 to bearing housing 20.

Fuel pump assembly 10 is a conventionally constructed automotive mechanical diaphragm-type fuel pump, such of that manufactured by the Carter Automotive Company, Inc. of St. Louis, Mo., under its Part No. 60932. Fuel pump assembly 10 generally includes an inlet nipple 56 which receives fuel from a fuel line (not shown), for supplying fuel to the interior of a cover 58. From cover 58, fuel is supplied to the interior of a cylindrical body 60 through a diaphragm-type check valve 62 disposed between cover 58 and body member 60. An outlet nipple 64 (FIG. 1) is mounted to body member 60, and a fuel line (not shown) is connected between outlet nipple 64 and the engine fuel system. A pumping diaphragm 66 is sandwiched between body member 60 and a housing 68. A linkage (not shown) is mounted within the interior of housing 68, and is interconnected with pumping diaphragm 66 and an actuator arm 70. Arm 70 is pivotably mounted to housing 68 adjacent mounting plate 52, and a spring 72 urges the outer end of arm 70 against the outer surface of cam member 48.

With the arrangement as shown and described, rotation of cam member 48 caused by rotation of water pump input shaft 22 results in reciprocating back-and-forth movement of actuator arm 70 of fuel pump assembly 10. Such movement of actuator arm 70 is transferred to pumping diaphragm 66, through the linkage housed within housing 68, and results in pumping of fuel through outlet nipple 64 to the engine fuel system by action of pumping diaphragm 66.

During rotation of cam member 48, spring 72 maintains the outer end of actuator arm 70 in contact with the outer surface of cam member 48. Referring again to FIG. 2, slip ring 50, which is mounted to the outer surface of cam member 42, provides the surface which the outer end of actuator arm 70 physically engages. Slip ring 50 acts to distribute the load exerted by actuator arm 70 over the width of cam member 48, to prevent excessive wear which otherwise may result.

Figure 4:
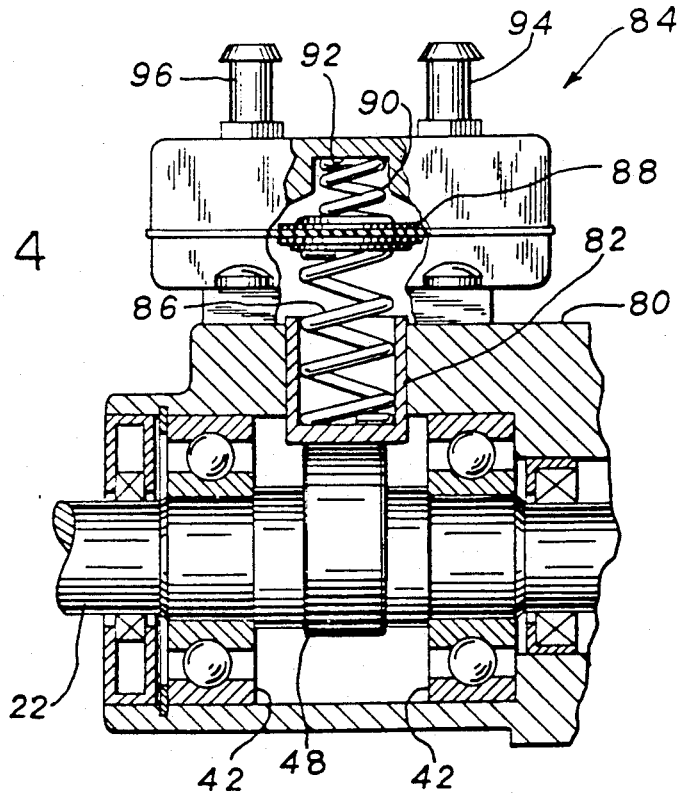
FIG. 4 is a partial sectional view of an alternate embodiment of a water pump and fuel pump assembly constructed according to the invention.

FIG. 4 illustrates another embodiment of a fuel pumping arrangement constructed according to the invention. In this embodiment, the components of water pump assembly 12 are generally as shown and described with respect to FIGS. 1 and 3, with the exception that bearing housing 20 is replaced with a bearing housing such as shown in FIG. 4 at 80. An actuator sleeve 82 is located within an opening formed in bearing housing 80, with the end of sleeve 82 engaging the outer surface of cam member 48. A fuel pump assembly 84 includes a spring 86 which extends through the interior of sleeve 82, and which bears between the end of sleeve 82 and a diaphragm 88 associated with fuel pump 84. Fuel pump 84 further includes a spring 90 engaged with the opposite surface of diaphragm 88, and bearing against a bearing surface 92 associated with the body of fuel pump 84. In this arrangement, the actuator arm such as shown in FIG. 3 at 70 is eliminated, and rotation of water pump input shaft 22 results in reciprocating up and down movement of sleeve 82 through cam member 48. This causes up and down movement of diaphragm 88, and drawing of fuel in through an inlet nipple 94 and pumping fuel out through an outlet nipple 96.

Various alternatives and embodiments are contemplated as being within the scope of the following claims particularly pointing out and distinctly claiming the subject matter regarded as the invention.

I claim:

1. In a marine propulsion system including an engine and a water pump having a rotatable input shaft driven in response to operation of the engine, the improvement comprising a fuel pump operably driven by rotation of the water pump input shaft.

2. The improvement of claim 1, wherein the fuel pump includes a movable actuator member interconnected with a fuel pumping member, and wherein a cam surface is provided on the water pump input shaft and the movable actuator member engages the cam surface, wherein rotation of the cam surface provided by rotation of the water pump input shaft causes reciprocating movement of the movable actuator member to provide reciprocating movement of the fuel pumping member.

3. The improvement of claim 2, wherein the cam surface is provided by a cam member mounted to the water pump input shaft.

4. The improvement of claim 2, wherein the fuel pumping member comprises a flexible diaphragm.

5. The improvement of claim 4, wherein the movable actuator member comprises a reciprocable arm having an inner and interconnected with the flexible diaphragm and an outer end disposed in engagement with the cam surface.

6. The improvement of claim 4, wherein the movable actuator member comprises a coil spring having one of its ends secured to the diaphragm and the other of its ends disposed within a sleeve member which bears against the cam surface.

7. In a marine propulsion system including an engine and a water pump comprising a housing, an impeller mounted within the housing, a rotatable input shaft rotatably disposed within the housing and interconnected with the impeller, wherein the rotatable input shaft is driven in response to operation of the engine, the improvement comprising a fuel pump mounted to the water pump housing, wherein the fuel pump is driven in response to rotation of the water pump input shaft.

8. The improvement of claim 7, wherein the fuel pump comprises a movable pumping member and a movable actuator member, and wherein a cam surface is provided on the water pump input shaft and the movable actuator member is engaged with the cam surface, so that rotation of the water pump input shaft causes reciprocating movement of the actuator member and thereby reciprocating movement of the fuel pump pumping member.

9. The improvement of claim 8, wherein the cam surface is provided by the outer surface of a cam member mounted to the water pump input shaft.

10. The improvement of claim 9, wherein the movable actuator member comprises an arm having an inner end and an outer end, and wherein the fuel pump is mounted to the water pump housing such that the arm extends into the interior of the housing and is oriented such that its outer end bears against the outer surface of the cam member.

11. The improvement of claim 10, wherein the portion of the water pump housing located adjacent the cam member mounted to the input shaft includes an opening, and wherein the fuel pump is mounted to the water pump housing so as to enclose the opening.

12. The improvement of claim 9, wherein the water pump input shaft is driven in response to operation of the engine by means of a driven pulley mounted to an end of the input shaft extending exteriorly from the water pump housing, wherein the driven pulley is driven by a drive belt driven by a drive pulley mounted to the engine crankshaft.

13. For a marine propulsion system including an engine and a water pump having an input shaft driven in response to operation of the engine, a method of operating a fuel pump comprising the step of mounting the fuel pump adjacent the water pump, and operating the fuel pump in response to rotation of the water pump input shaft.

14. The method of claim 13, wherein the fuel pump comprises a movable pumping member and a movable actuator member, and wherein the step of operating the fuel pump in response to rotation of the water pump input shaft comprises providing a cam surface on the input shaft and engaging the fuel pump movable actuator member with the cam surface, so that rotation of the water pump input shaft causes reciprocating movement of the actuator member to operate the movable pumping member.

15. The method of claim 14, wherein the step of providing a cam surface on the water pump input shaft comprises mounting a cam member to the input shaft, and wherein the fuel pump actuator member is engaged with the outer surface of the cam member.

16. The method of claim 14, wherein the water pump includes a housing within which the input shaft is disposed, and wherein the housing includes an opening, and wherein the step of mounting the fuel pump adjacent the water pump comprises mounting the fuel pump to the water pump housing so as to enclose the opening therein, wherein the fuel pump actuator member extends into the housing to engage the cam surface provided on water pump input shaft.

* * * * *